US008441424B2

(12) United States Patent
Lee

(10) Patent No.: US 8,441,424 B2
(45) Date of Patent: May 14, 2013

(54) LIQUID CRYSTAL DISPLAY DEVICE AND METHOD OF DRIVING THE SAME

(75) Inventor: Ju-Young Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 833 days.

(21) Appl. No.: 11/607,848

(22) Filed: Dec. 4, 2006

(65) Prior Publication Data

US 2008/0001882 A1 Jan. 3, 2008

(30) Foreign Application Priority Data

Jun. 29, 2006 (KR) ..... 10-2006-059402

(51) Int. Cl.
*G09G 3/36* (2006.01)

(52) U.S. Cl.
USPC ..... 345/92

(58) Field of Classification Search ..... 345/92, 345/94, 96, 98, 99, 100
See application file for complete search history.

(56) References Cited

U.S. PATENT DOCUMENTS

| | | | | |
|---|---|---|---|---|
| 5,602,560 | A * | 2/1997 | Ikeda | 345/94 |
| 6,850,289 | B2 | 2/2005 | Lee | |
| 6,885,359 | B2 * | 4/2005 | Tsutsui | 345/100 |
| 7,133,034 | B2 * | 11/2006 | Park et al. | 345/204 |
| 2004/0041153 | A1 | 3/2004 | Lee | |
| 2004/0095338 | A1 * | 5/2004 | Miyazawa | 345/204 |
| 2004/0150612 | A1 * | 8/2004 | Okuzono et al. | 345/100 |
| 2005/0052381 | A1 | 3/2005 | Lee | |
| 2006/0279688 | A1 * | 12/2006 | Wu et al. | 349/155 |

FOREIGN PATENT DOCUMENTS

| | | |
|---|---|---|
| EP | 0 423 887 | 4/1991 |
| JP | 2-312371 | 12/1990 |
| JP | 7-294882 | 11/1995 |
| TW | I240236 | 9/2005 |

* cited by examiner

*Primary Examiner* — Amr Awad
*Assistant Examiner* — Andre Matthews
(74) *Attorney, Agent, or Firm* — McKenna Long & Aldridge, LLP

(57) ABSTRACT

A driver circuit for an LCD display includes; a gate line; a data line crossing the gate line; a feed TFT connected to the gate line; a feed control line connected to the feed TFT to switch on the feed TFT; and a feed signal line connected to the feed TFT to supply a feed signal to the gate line.

27 Claims, 9 Drawing Sheets

LIQUID CRYSTAL DISPLAY DEVICE AND METHOD OF DRIVING THE SAME

This application claims the benefit of Korean Patent Application No. 2006-0059402, filed on Jun. 29, 2006, which is hereby incorporated by reference for all purposes as if fully set forth herein.

BACKGROUND OF THE INVENTION

1. Field of the Invention

The present invention relates to a liquid crystal display (LCD) device, and more particularly, to an LCD device including a plurality of auxiliary thin film transistors (TFTs) and a method of driving the LCD device.

2. Discussion of the Related Art

With the advance of the information age, devices for displaying information are actively being developed. In particular, flat panel display (FPD) devices having a thin profile, light weight and low power consumption are actively being developed as substitutes for cathode ray tube (CRT) devices. For example, liquid crystal display (LCD) devices, plasma display panels (PDP), field emission display (FED) devices and electroluminescent display (ELD) devices have been researched and developed as FPD devices. Of these FPD devices, liquid crystal display (LCD) devices are widely used as monitors for notebook computers and desktop computers because of their high resolution, high contrast ratio, color rendering capability and superior performance for displaying moving images.

A liquid crystal display (LCD) device relies on the optical anisotropy and polarizing properties of liquid crystal to produce an image. Due to the optical anisotropy of liquid crystal molecules, refraction of light incident onto a liquid crystal depends on the alignment direction of the liquid crystal molecules. Liquid crystal molecules have directional alignment characteristics resulting from their long, thin shapes. The alignment direction of the liquid crystal molecules can be controlled by applying an electric field across the liquid crystal.

FIG. 1 is a schematic cross-sectional view showing a liquid crystal display device according to the related art, and FIG. 2 is a schematic equivalent circuit diagram showing an array substrate for a liquid crystal display device according to the related art. In addition, FIG. 3 is a schematic magnified view of a portion "III" of FIG. 2. FIGS. 1 and 2 show an active matrix liquid crystal display (AM-LCD) device having thin film transistors (TFTs) and pixel electrodes arranged in a matrix form.

As illustrated in FIGS. 1, 2 and 3, an LCD device 10 of the related art includes a first substrate 20 and a second substrates 30 referred to as a color filter substrate and an array substrate, respectively. A common electrode 24 and a pixel electrode 32 are formed on the first substrate 20 and the second substrate 30, respectively, with the common electrode 24 facing the pixel electrode 32. A liquid crystal layer 50 is interposed between the first and second substrates 20 and 30.

A black matrix 26 is formed on the first substrate 20 and a color filter layer 22 is formed on the black matrix 26 and the first substrate 20. The common electrode 24 is formed on the color filter layer 22. The color filter layer 22 may include red, green and blue color filters. The black matrix 26 disposed between adjacent two color filters to block light not passing through a color filter. A plurality of gate lines "G1" to "Gn" and a plurality of data lines "D1" to "Dm" are formed on the second substrate 30 with the gate lines and data lines crossing each other to define pixel regions "P." A thin film transistor (TFT) "T" is connected to a gate line "G1" to "Gn" and a data line "D1" to "Dm," and the pixel electrode 32 is connected to the TFT "T." The TFT "T" and the pixel electrode 32 are formed in each pixel region "P."

The common electrode 24, the pixel electrode 32 and the liquid crystal layer 50 constitute a liquid crystal capacitor "$C_{LC}$." In addition, a storage capacitor "$C_{ST}$" in parallel with the liquid crystal capacitor "$C_{LC}$" is connected to the TFT "T." First and second polarizing plates 28 and 34 are formed on outer surfaces of the first and second substrates 20 and 30, respectively.

A gate driver 38 and a data driver 42 are disposed at respective sides of the second substrate. The gate driver 38 is connected to the plurality of gate lines "G1" to "Gn" and sequentially supplies gate pulses to the plurality of gate lines "G1" to "Gn." The data driver 42 is connected to the plurality of data lines "D1" to "Dm" and supplies data pulses to the plurality of data lines "D1" to "Dm." The gate pulse is an ON voltage turning on the TFT "T" and a data pulse is a liquid crystal driving voltage for changing the alignment of liquid crystal molecules.

The TFT "T" includes a gate electrode, a source electrode and a drain electrode. The gate electrode and the source electrode are connected to the gate line "G1" to "Gn" and the data line "D1" to "Dm," respectively. The drain electrode is connected to the liquid crystal capacitor "$C_{LC}$." The TFT "T" is turned on and off according to the gate pulse and functions as a switch for application of a data pulse to the liquid crystal capacitor "$C_{LC}$."

The LCD device 10 displays images by frames. The gate driver 38 sequentially supplies the gate pulses to the plurality of gate lines "G1" to "Gn" during each frame. In addition, the data driver 42 supplies the data pulses corresponding to the gate pulses to the plurality of data lines "D1" to "Dm." As shown in FIG. 3, when a gate pulse is supplied to the $(n-1)^{th}$ gate line "Gn−1", for example, the data pulses are supplied concurrently to all of the plurality of data lines "D1" to "Dm". Accordingly, the first to $m^{th}$ TFTs "T1" to "Tm" connected to the $(n-1)^{th}$ gate line "Gn−1" are turned on and the data pulses are supplied to the liquid crystal capacitors "$C_{LC}$" of pixel regions "P" through the plurality of data lines "D1" to "Dm." As a result, the liquid crystal capacitors "$C_{LC}$" are charged with a voltage and the alignment of the liquid crystal molecules are changed according to the charged voltage. The change in alignment of the liquid crystal molecules causes a change in transmittance of the liquid crystal layer 50 and the LCD device displays color images by color combination of light transmitted through red, green and blue color filters.

The LCD device 10 further includes a backlight unit 60 under the second substrate 30. Since the LCD device 10 is a non-emissive display device, the backlight unit 60 supplies light to the liquid crystal layer 50 for generating an image. Even though not shown in FIGS. 1 to 3, a seal pattern is formed at a boundary of the first and second substrates 20 and 30 to prevent leakage of the liquid crystal layer 50. In addition, a first orientation film is formed between the common electrode 24 and the liquid crystal layer 50 and a second orientation film is formed between the pixel electrode 32 and the liquid crystal layer 50 to establish an initial orientation of the molecules of the liquid crystal layer 50.

During operation of the LCD device 10, the gate pulse is transmitted from one end to the other end of each of the gate lines "G1" to "Gn." Since the gate lines "G1" to "Gn" each has a resistance and a capacitance, the shape of the gate pulse is distorted due to an RC delay as the pulse propagates from end to end along a gate line.

FIGS. 4A and 4B are schematic graphs showing the shapes of a gate pulse and a data pulse supplied to first and $m^{th}$ pixel regions, respectively, corresponding to an $(n-1)^{th}$ gate line of FIG. 3. Gate pulses and the data pulses having the shapes shown in FIGS. 4A and 4B are applied to each of the plurality of gate lines "G1" to "Gn" and data lines "D1" to "Dm," respectively. The first to $m^{th}$ TFTs "T1" to "Tm" are connected to the $(n-1)^{th}$ gate line "Gn−1." The first and $m^{th}$ TFT "T1" and "Tm" correspond to first and second ends of the $(n-1)^{th}$ gate line "Gn−1," respectively. FIG. 4A shows an initial shape of an $(n-1)^{th}$ gate pulse "G(N−1)" applied to the first TFT "T1" corresponding to the first end of the $(n-1)^{th}$ gate line "Gn−1" and FIG. 4B shows a final shape of the $(n-1)^{th}$ gate pulse "G(N−1)" applied to the $m^{th}$ TFT "Tm" corresponding the second end of the $(n-1)^{th}$ gate line "Gn−1."

The $(n-1)^{th}$ data pulse "D(N−1)" is transmitted to the first to $m^{th}$ TFTs "T1" to "Tm" while the gate pulse is applied to the $(n-1)^{th}$ gate line "Gn−1." In addition, the $(n-2)^{th}$ data pulse "D(n−2)" is transmitted to the first to $m^{th}$ TFTs "T1" to "Tm" while the gate pulse is applied to the $(n-2)^{th}$ gate line "Gn−2," and the $n^{th}$ data pulse "D(N)" is transmitted to the first to $m^{th}$ TFTs "T1" to "Tm" while the gate pulse is applied to the $n^{th}$ gate line "Gn." FIG. 4A shows a shape of the $(n-1)^{th}$ data pulse "D(N−1)" transmitted to the first TFT "T1" corresponding to the first end of the $(n-1)^{th}$ gate line "Gn−1" and FIG. 4B shows a shape of the $(n-1)^{th}$ data pulse "D(N−1)" transmitted to the $m^{th}$ TFT "Tm" corresponding the second end of the $(n-1)^{th}$ gate line "Gn−1."

The $(n-1)^{th}$ gate pulse "G(N−1)" and the $(n-1)^{th}$ data pulse "D(N−1)" each have a rising time and a falling time. A voltage of the $(n-1)^{th}$ gate pulse "G(N−1)" and the $(n-1)^{th}$ data pulse "D(N−1)" increases from an initial value to a final value during the rising time and decreases from the final value to the initial value during the falling time. The voltage of the $(n-1)^{th}$ gate pulse "G(N−1)" and the $(n-1)^{th}$ data pulse "D(N−1)" is maintained at constant value for a time period between the rising time and the falling time. When the $(n-1)^{th}$ gate pulse "G(N−1)" rises to a voltage greater than a threshold voltage "Vth," the first to $m^{th}$ TFTs "T1" to "Tm" are turned on and the $(n-1)^{th}$ data pulse "D(N−1)" is applied to the liquid crystal capacitor "$C_{LC}$" to charge up the liquid crystal capacitor "$C_{LC}$." When the $(n-1)^{th}$ gate pulse "G(N−1)" falls to a voltage smaller than the threshold voltage "Vth," the first to $m^{th}$ TFTs "T1" to "Tm" are turned off and the $(n-1)^{th}$ data pulse "D(N−1)" is not applied to the liquid crystal capacitor "$C_{LC}$."

As a result, the $(n-1)^{th}$ data pulse "D(N−1)" charges up the liquid crystal capacitor "$C_{LC}$" in the first pixel region "PXL1" during a first charging time period "Ta(1)" and charges up the liquid crystal capacitor "$C_{LC}$" in the $m^{th}$ pixel region "PXLm" during an $m^{th}$ charging time period "Ta(m)." Further, the first TFT "T1" is turned off after the $(n-1)^{th}$ gate pulse "G(N−1)" falls during a first off time period "Tb(1)" to have the threshold voltage "Vth" and the $m^{th}$ TFT "Tm" is turned off after the $(n-1)^{th}$ gate pulse "G(N−1)" falls during an $m^{th}$ off time period "Tb(m)" to have the threshold voltage "Vth."

To prevent a noise signal due to the $n^{th}$ data pulse "D(N)," the $(n-1)^{th}$ data pulse "D(N−1)" is maintained a constant value during a predetermined time period after the $(n-1)^{th}$ gate pulse "G(N−1)" begins to fall, and then begins to fall only after the $(n-1)^{th}$ gate pulse "G(N−1)" voltage falls below the threshold voltage of the first to $m^{th}$ TFTs "T1" to "Tm." The first to $m^{th}$ TFTs "T1" to "Tm" each are in an ON state even after the $(n-1)^{th}$ gate pulse "G(N−1)" begins to fall until the time when the $(n-1)^{th}$ gate pulse "G(N−1)" reaches the threshold voltage "Vth." A TFT may be in a slight or partial ON state even when the $(n-1)^{th}$ gate pulse "G(N−1)" has a voltage smaller than the threshold voltage "Vth" due to a property of the TFT device. Were the $(n-1)^{th}$ gate pulse "G(N−1)" and the $(n-1)^{th}$ data pulse "D(N−1)" start to fall simultaneously, the $n^{th}$ data pulse "D(N)" for the $n^{th}$ gate line "Gn" might be applied to the liquid crystal capacitor "$C_{LC}$" currently charged up with the $(n-1)^{th}$ data pulse "D(N−1)" before the first to $m^{th}$ TFTs "T1" to "Tm" connected to the $(n-1)^{th}$ gate line "Gn−1" are turned off. Accordingly, the $n^{th}$ data pulse "D(N)" may be mixed with the $(n-1)^{th}$ data pulse "D(N−1)" in the liquid crystal capacitor "$C_{LC}$" causing a noise signal. In order to prevent the noise signal, the $(n-1)^{th}$ data pulse "D(N−1)" is maintained at constant voltage for a predetermined time period after the $(n-1)^{th}$ gate pulse "G(N−1)" begins to fall, and only begins to fall after the $(n-1)^{th}$ gate pulse "G(N−1)" voltage falls below the threshold voltage turning off the first to $m^{th}$ TFTs "T1" to "Tm".

The initial shape of the $(n-1)^{th}$ gate pulse "G(N−1)" in FIG. 4A is different from the final shape of the $(n-1)^{th}$ gate pulse "G(N−1)" in FIG. 4B due to the equivalent resistance and equivalent capacitance of the $(n-1)^{th}$ gate line "Gn−1." The $(n-1)^{th}$ gate pulse "G(N−1)" applied to the first TFT "T1" is transmitted to the $m^{th}$ TFT "Tm" through the $(n-1)^{th}$ gate line "Gn−1." The $(n-1)^{th}$ gate line "Gn−1" includes a conductive material having a resistance and a capacitance. The total resistance and capacitance of the $(n-1)^{th}$ gate line "Gn−1" may be represented by an equivalent resistance and an equivalent capacitance, respectively. The equivalent resistance and the equivalent capacitance of the $(n-1)^{th}$ gate line "Gn−1" generate an RC delay applied to the $(n-1)^{th}$ gate pulse "G(N−1)" transmitted through the $(n-1)^{th}$ gate line "Gn−1." As a result, the $(n-1)^{th}$ gate pulse "G(N−1)" is distorted such that the rise time and the falling time are extended. As the equivalent resistance and the equivalent capacitance increase the RC delay increases. The distortion of the gate pulse shape due to the RC delay causes a deterioration of the display quality of the LCD device.

As described above, to solve the problem of the interference from the $n^{th}$ data pulse "D(N)" for the $n^{th}$ gate line "Gn," the $(n-1)^{th}$ data pulse "D(N−1)" is maintained at constant voltage during a predetermined time period after the $(n-1)^{th}$ gate pulse "G(N−1)" begins to fall, and only begins to fall after the $(n-1)^{th}$ gate pulse "G(N−1)" falls to a voltage smaller than the threshold voltage "Vth"

As shown in FIG. 4B, as the falling time is extended due to the RC delay, the $m^{th}$ off time period "Tb(m)" must be extended and the $m^{th}$ charging time period "Ta(m)" is shortened to prevent the noise signal problem due to the $n^{th}$ data pulse "D(N)" for the $n^{th}$ gate line "Gn." However, when the $m^{th}$ charging time period "Ta(m)" is shortened, the time available for charging the liquid crystal capacitor "$C^{LC}$" with the $(n-1)^{th}$ data pulse "D(N−1)" is insufficient and the alignment of the liquid crystal molecules is not completely changed to achieve the required transmittance. The insufficient transmittance change results in a non-uniformity of brightness and contrast ratio between right and left portions of the LCD device display, as well as image sticking and flicker. As a result the display quality of the LCD device is reduced.

As a solution for the insufficient charging problem described above, new conductive materials having a relatively low resistance for the gate line have been researched. Additionally, methods using additional circuitry to for gate modulation and employing gate drivers disposed at both ends of the gate lines have been suggested. However, these solutions increase the cost of the LCD device and do not sufficiently address the problems due to the RC delay along the gate line.

SUMMARY OF THE INVENTION

Accordingly, the present invention is directed to a liquid crystal display device and a method of driving the same that substantially obviates one or more of the problems due to limitations and disadvantages of the related art.

An advantage of the present invention is to provide a liquid crystal display device addressing the problem of falling time extension due to an RC delay and a method of driving the liquid crystal display device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driver circuit for an LCD display includes; a gate line; a data line crossing the gate line; a feed TFT connected to the gate line; a feed control line connected to the feed TFT to switch on the feed TFT; and a feed signal line connected to the feed TFT to supply a feed signal to the gate line.

In another aspect of the present invention, a method of driving an LCD display includes: applying a gate pulse to a gate line of the LCD display; and supplying a feed signal pulse synchronized with the gate pulse to the gate line.

In another aspect, an LCD device includes: a gate line and crossing a data line on a first substrate; a second substrate separated from the first substrate by a predetermined distance; a liquid crystal layer disposed between the first and second substrates; a feed TFT connected to the gate line; a feed control line connected to the feed TFT to switch on the feed TFT; and a feed signal line connected to the feed TFT to supply a feed signal to the gate line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, an example of which is illustrated in the accompanying drawings. Wherever possible, similar reference numbers will be used to refer to the same or similar parts.

Figure 1:
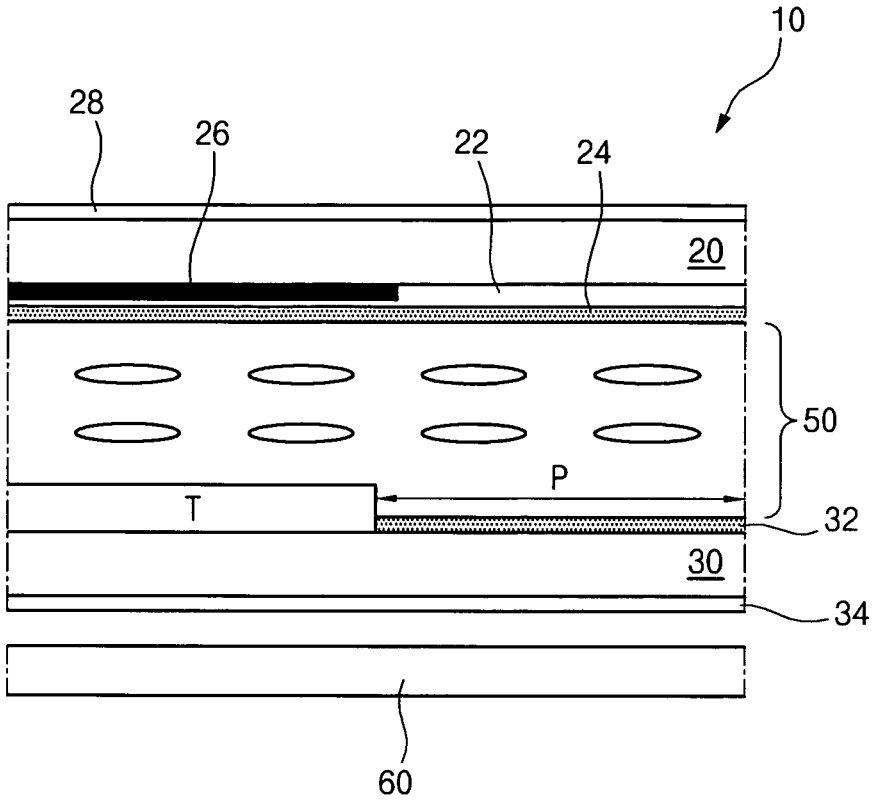
(related art) FIG. 1
FIG. 1 is a schematic cross-sectional view showing a liquid crystal display device according to the related art.
Figure 2:
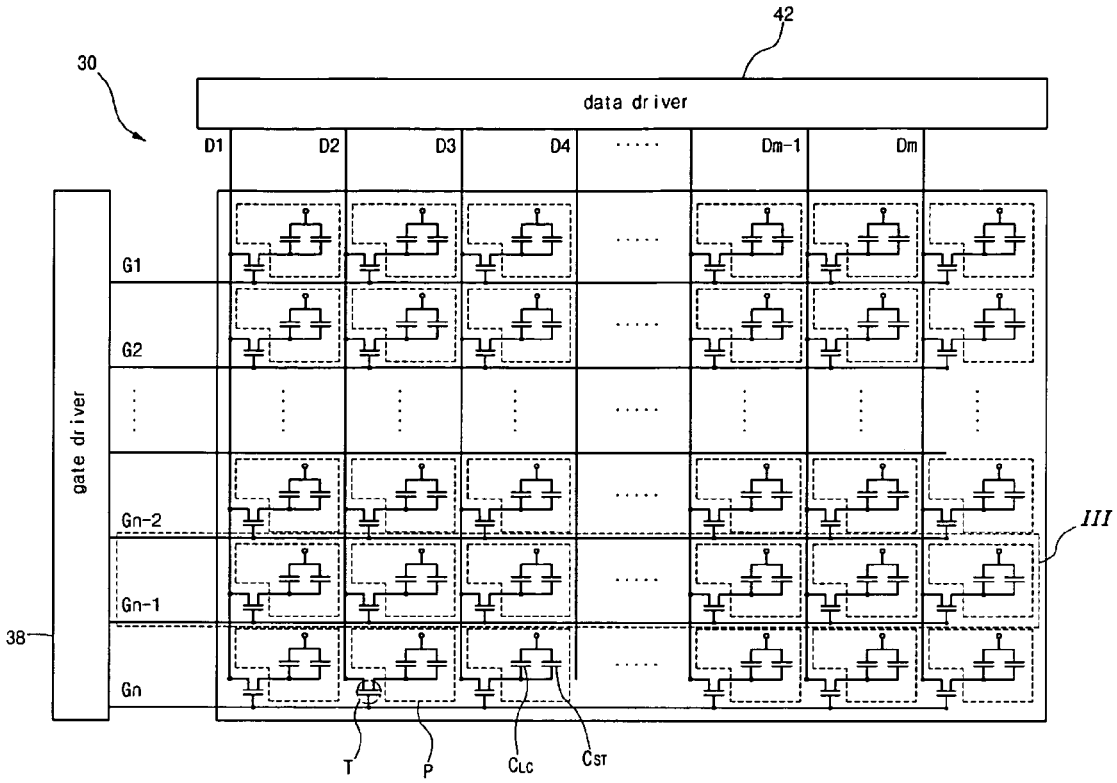
(related art) FIG. 2
FIG. 2 is a schematic equivalent circuit diagram showing an array substrate for a liquid crystal display device according to the related art.
Figure 3:
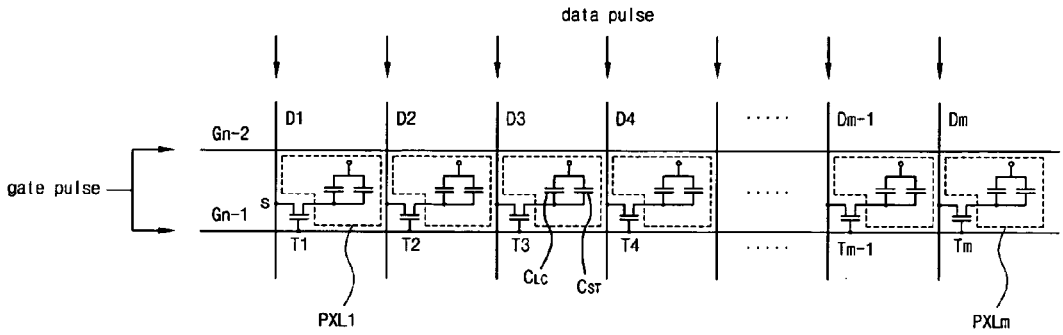
(related art) FIG. 3
FIG. 3 is a magnified view of a portion "III" of FIG. 2.
Figure 4A:
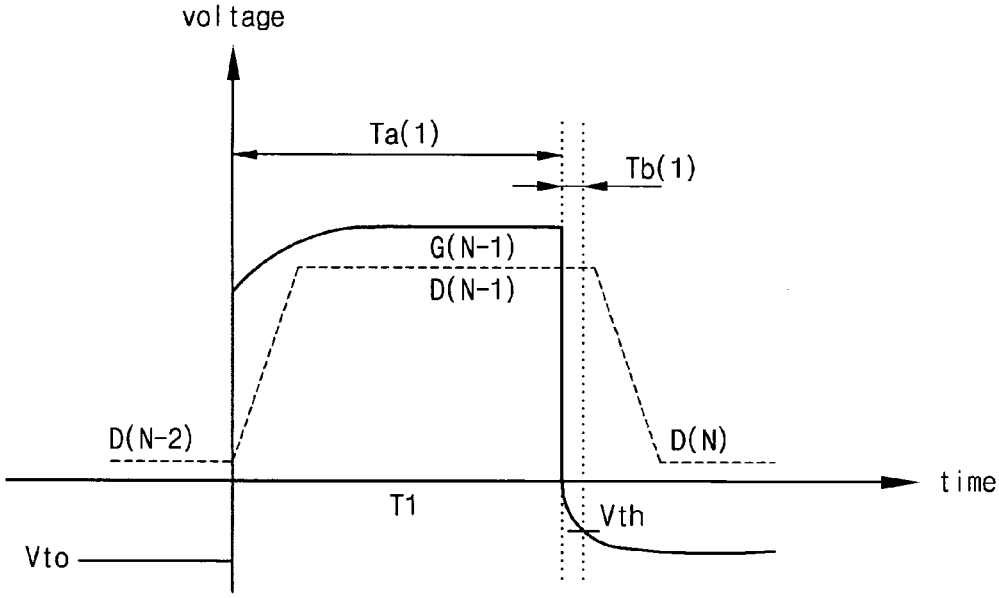
(related art) FIG. 4A
FIGS. 4A and 4B are waveform diagrams showing the shapes of a gate pulse and a data pulse supplied to first and $m^{th}$ pixel regions, respectively, corresponding to an $(n-1)^{th}$ gate line of FIG. 3.
Figure 4B:
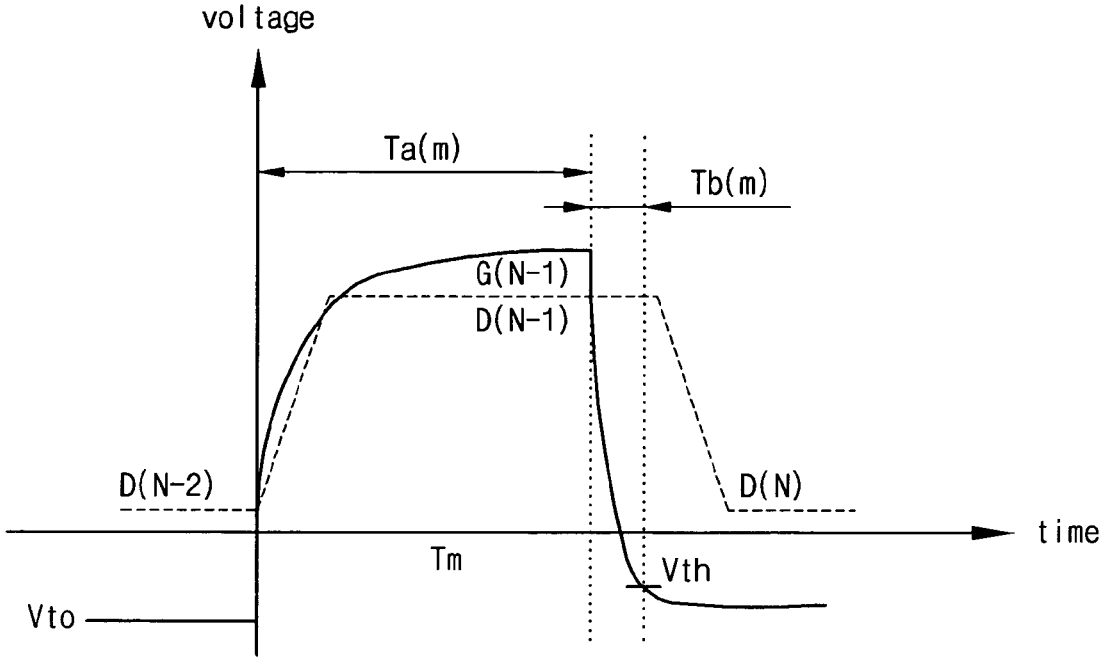
(related art) FIG. 4B
Figure 5:
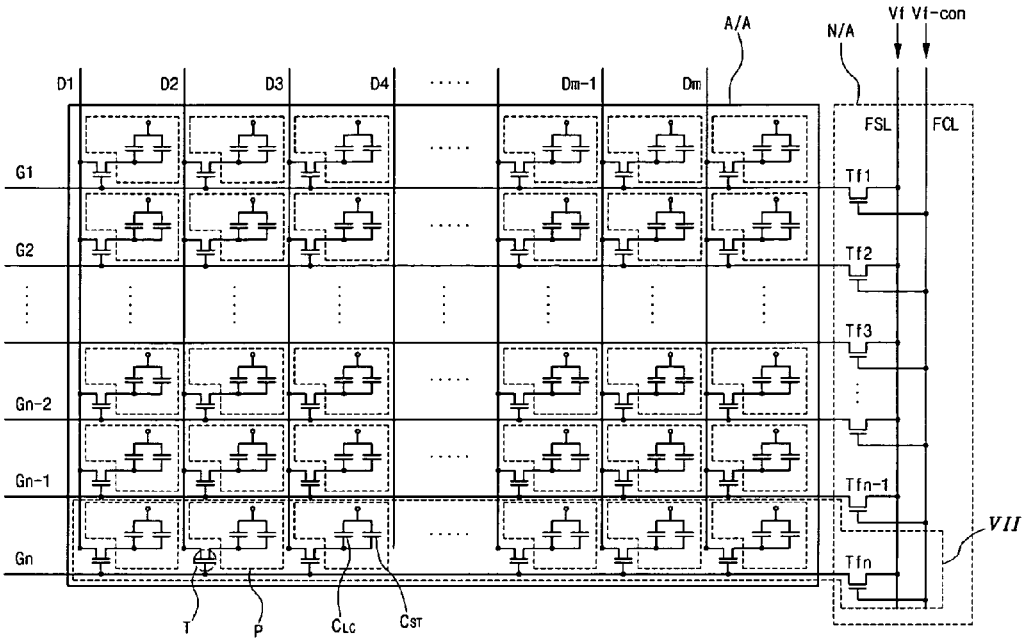
FIG. 5 is a schematic equivalent circuit diagram showing a liquid crystal display device according to an embodiment of the present invention.

FIG. 5 is a schematic equivalent circuit diagram showing a liquid crystal display device according to an embodiment of the present invention.

In FIG. 5, a liquid crystal display (LCD) device includes a display area "AA" in which an image is displayed and a non-display area "NA" provided with a black matrix in which an image. A plurality of gate lines "G1" to "Gn" and a plurality of data lines "D1" to "Dm" are formed in the display area "AA." The gate lines "G1" to "Gn" cross the data lines "D1" to "Dm" to define a pixel regions "P." A thin film transistor (TFT) "T" is connected to the gate line "G1" to "Gn" and the data line "D1" to "Dm," and a liquid crystal capacitor "$C_{LC}$" and a storage capacitor "$C_{ST}$" in each pixel region "P" are connected to the TFT "T." Gate pulses, each having a low level voltage "Vg1" (of FIG. 6) and a high level voltage "Vgh" (of FIG. 6) are sequentially supplied to the plurality of gate lines "G1" to "Gn." For example Vg1 may be about −5V and Vgh may be about +25V. In addition, data pulses synchronized with the gate pulses are supplied to the plurality of data lines "D1" to "Dm."

A plurality of feed TFTs "Tf1" to "Tfn" are formed in the non-display area "NA." The each of the plurality of feed TFTs "Tf1" to "Tfn" are connected to a respective gate line of the plurality of gate lines "G1" to "Gn." Each gate line has first and second ends, and a gate driver and the feed TFT are connected to the first and second ends of each gate line, respectively. Further, each of the plurality of feed TFTs "Tf1" to "Tfn" are connected to a feed control line "FCL" and a feed signal line "FSL." Each of the plurality of feed TFTs "Tf1" to "Tfn" has a gate electrode, a source electrode and a drain electrode. The drain electrode of each of the plurality of feed TFTs "Tf1" to "Tfn" is connected a respective one of the plurality of gate lines "G1" to "Gn." In addition, the gate electrode of each of the plurality of feed TFTs "Tf1" to "Tfn" is connected to the feed control line "FCL" and the source electrode of each of the plurality of feed TFTs "Tf1" to "Tfn" is connected to the feed signal line "FSL." A feed control signal "Vf-con" is transmitted to the gate electrode through the feed control line "FCL" to turn on and off the plurality of feed TFTs "Tf1" to "Tfn." A feed signal "Vf" is transmitted to the source electrode through the feed signal line "FSL." Each of the plurality of feed TFTs "Tf1" to "Tfn" may be formed through the same process as the TFT "T" in the display area "AA" so that the plurality of feed TFTs "Tf1" to "Tfn" can be of the same type as the TFT "T." For example, the plurality of feed TFTs "Tf1" to "Tfn" and the TFT "T" may have an N (negative) type.

The feed control signal "Vf-con" when supplied to the feed control line "FCL" turns on each of the plurality of feed TFTs "Tf1" to "Tfn." For example, the feed control signal "Vf-con" may have a voltage within a range of about 20V to about 30V. In addition, the feed signal "Vf" supplied to the feed signal line "FSL" may have a voltage within a range of about −10V to about −5V. The feed signal "Vf" is applied to the plurality of gate lines "G1" to "Gn" through the plurality of feed TFTs "Tf1" to "Tfn" turned on by the feed control signal "Vf-con"

during a feed time period. The feed time period may have a range of about 1 μsec to about 3 μsec. The feed control signal "Vf-con" may be at the high level voltage "Vgh" of the gate pulse supplied to the plurality of gate lines "G1" to "Gn". Alternatively, the feed signal "Vf" may be at the low level voltage "Vg1" of the gate pulse. Since the feed signal "Vf" and the feed control signal "Vf-con" may have voltage levels equal to those of the gate pulse, the feed signal "Vf" and the feed control signal "Vf-con" may be generated by using a gate driver for the gate pulse. Alternatively, a separate feed control circuit independent of the gate driver may be used to generate the feed signal "Vf" and the feed control signal "Vf-con." For example, a gate output enable signal "GOE" to be transmitted from a timing controller to the gate driver may be amplified using a level shifter in the gate driver and then supplied to the feed control line "FCL" as the feed control signal "Vf-con" in synchrony with an input timing of the gate output enable signal "GOE."

Figure 6:
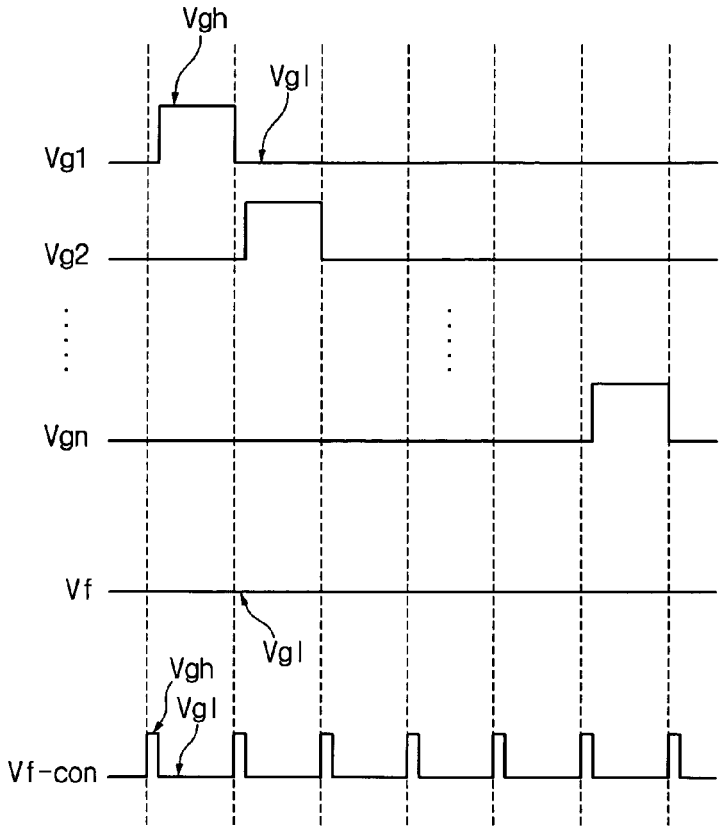
FIG. 6 is a timing diagram showing signals used in a liquid crystal display device according to an embodiment of the present invention.

FIG. 6 is a timing diagram showing signals used in a liquid crystal display device according to an embodiment of the present invention.

As illustrated in FIG. 6, the feed signal "Vf" is applied to the plurality of gate lines "G1" to "Gn" such that the feed signal "Vf" is synchronized with a falling timing of the gate pulse "Vg1" to "Vgn" supplied to the plurality of gate lines "G1" to "Gn." Because the feed signal "Vf" has a negative voltage, the feed signal "Vf" shortens the falling time of the gate pulse "Vg1" to "Vgn" from the high level voltage "Vgh" to the threshold voltage "Vth" for each TFT "T1" to "Tm."

Figure 7:
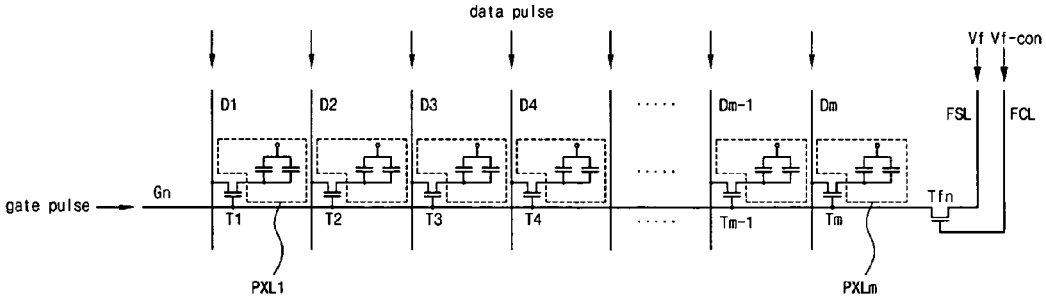
FIG. 7 is a magnified view of a portion "VII" of FIG. 5.
Figure 8A:
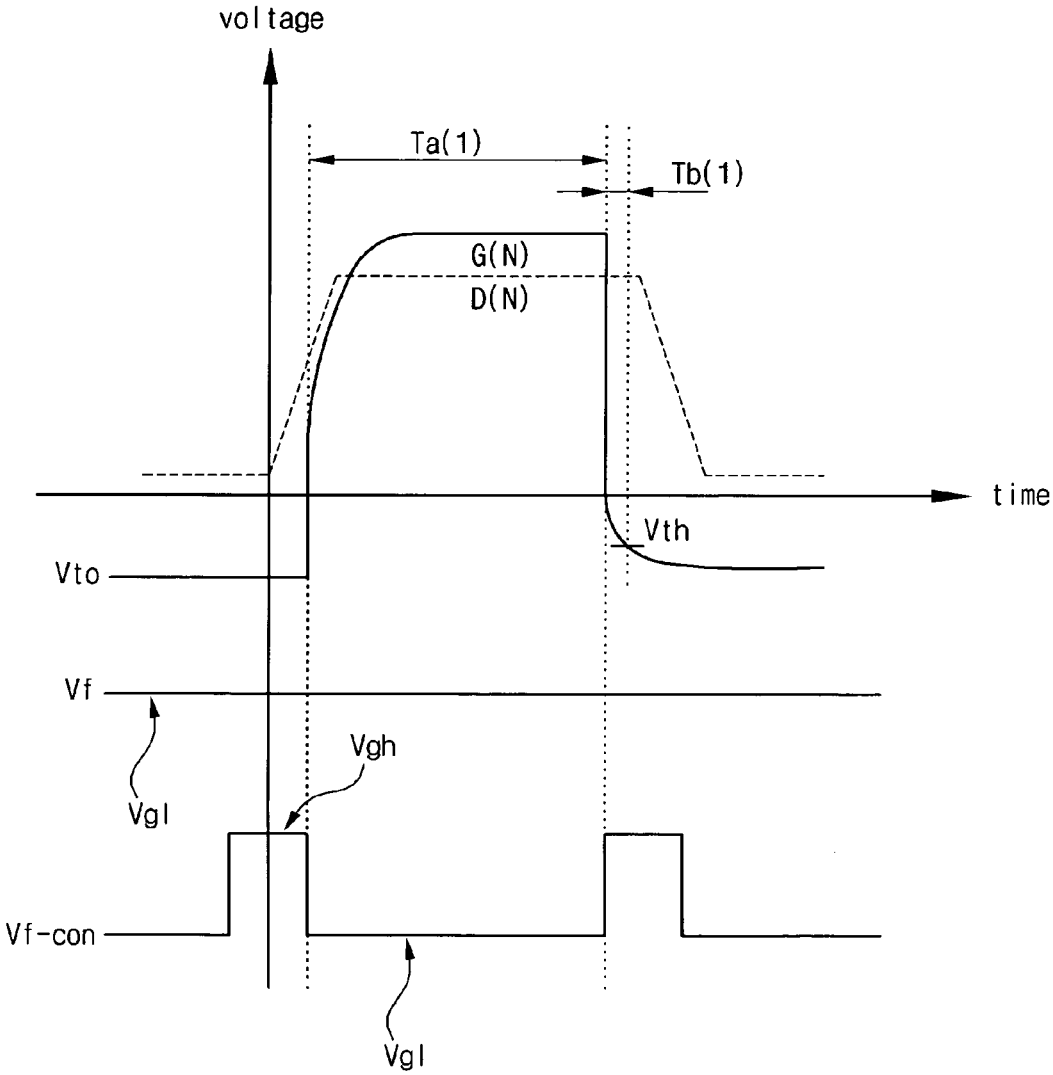
FIGS. 8A and 8B are waveform diagrams showing a gate pulse, a data pulse and a feed signal supplied to first and $m^{th}$ pixel regions, respectively, corresponding to an $(n)^{th}$ gate line of FIG. 7.
Figure 8B:
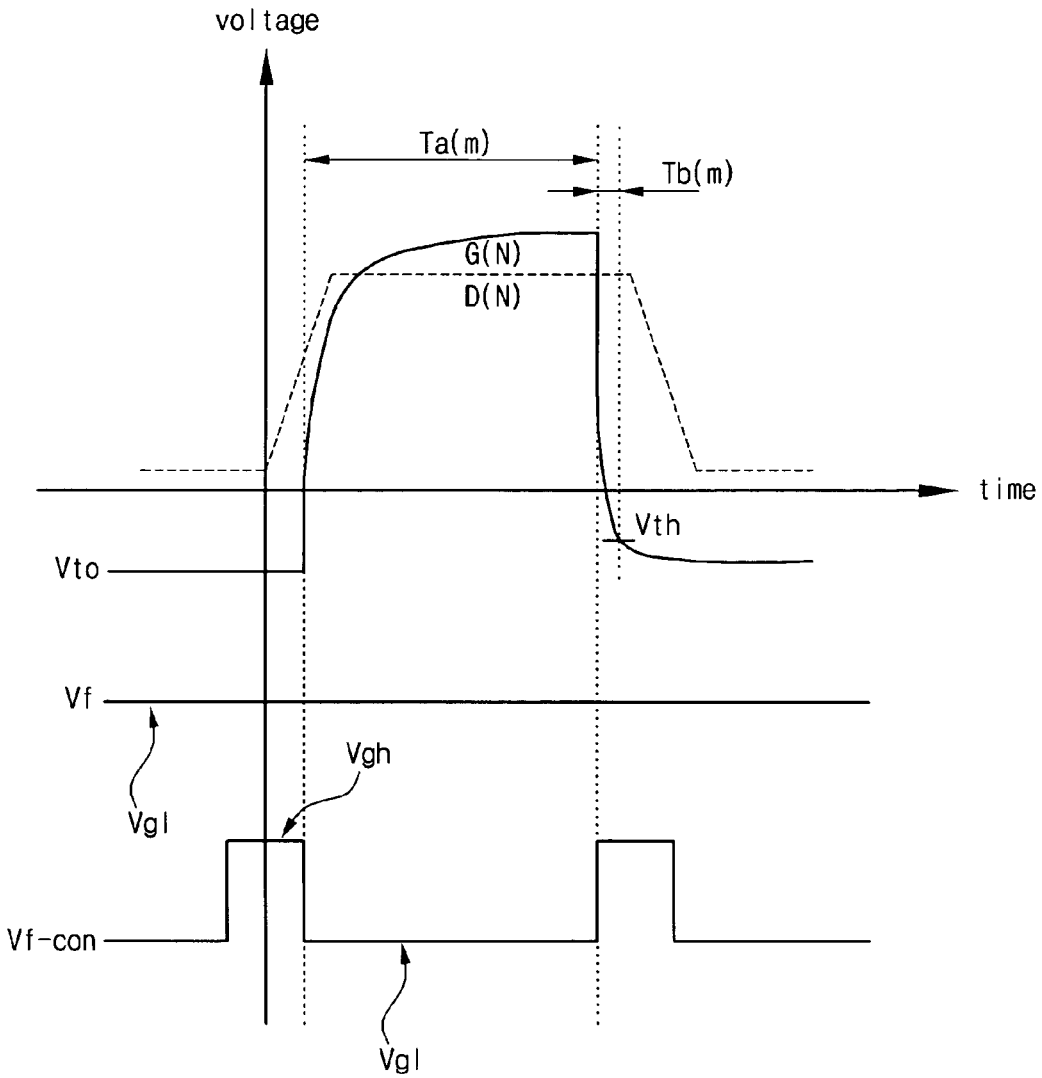

FIG. 7 is a magnified view of a portion "VII" of FIG. 5, and FIGS. 8A and 8B are waveform diagrams showing a gate pulse, a data pulse and a feed signal supplied to first and $m^{th}$ pixel regions, respectively, corresponding to an $(n)^{th}$ gate line of FIG. 7.

Gate pulses and the data pulses shaving the shapes shown in FIGS. 8A and 8B may be applied to each of the plurality of gate lines "G1" to "Gn" and data lines "D1" to "Dm," respectively. The first to $m^{th}$ TFTs "T1" to "Tm" are connected to the $(n)^{th}$ gate line "Gn." The first and $m^{th}$ TFT "T1" and "Tm" correspond to first and second ends of the $(n)^{th}$ gate line "Gn," respectively. FIG. 8A shows a shape of a gate pulse "G(N)" applied to the first TFT "T1" corresponding to the first end of the $(n)^{th}$ gate line "Gn" and FIG. 8B shows a shape of the gate pulse "G(N)" applied to the $m^{th}$ TFT "Tm" corresponding the second end of the $(n)^{th}$ gate line "Gn."

In addition, the $n^{th}$ data pulse "D(N)" is transmitted to the first to $m^{th}$ TFTs "T1" to "Tm" while the gate pulse "G(N)" is applied to the $(n)^{th}$ gate line "Gn." FIG. 8A shows a shape of the $n^{th}$ data pulse "D(N)" transmitted to the first TFT "T1" corresponding to the first end of the $(n)^{th}$ gate line "Gn" and FIG. 8B shows a shape of the $n^{th}$ data pulse "D(N)" transmitted to the $m^{th}$ TFT "Tm" corresponding the second end of the $(n)^{th}$ gate line "Gn." For example, the gate pulse "G(N)" may be supplied to the $(n)^{th}$ gate line "Gn" and the data pulse "D(N)" may be supplied to the plurality of data lines "D1" to "Dm" at the same time.

The gate pulse "G(N)" and the data pulse "D(N)" each have a rising time period and a falling time. A voltage of the gate pulse "G(N)" and the data pulse "D(N)" increases from an initial value to a final value during the rising time and decreases from the final value to the initial value during the falling time. The voltage of the gate pulse "G(N)" and the data pulse "D(N)" are each maintained at a constant voltage for a time period between its respective rising time and the falling time. When the gate pulse "G(N)" rises to have a voltage greater than a threshold voltage "Vth," the first to $m^{th}$ TFTs "T1" to "Tm" are turned on and the data pulse "D(N)" is applied to the liquid crystal capacitor "$C_{LC}$" to charge up the liquid crystal capacitor "$C_{LC}$." When the gate pulse "G(N)" falls to have a voltage smaller than the threshold voltage "Vth," the first to $m^{th}$ TFTs "T1" to "Tm" are turned off and the data pulse "D(N)" ceases to be applied to the liquid crystal capacitor "$C_{LC}$".

As a result, the data pulse "D(N)" charges up the liquid crystal capacitor "$C_{LC}$" in the first pixel region "PXL1" during a first charging time period "Ta(1)" and charges up the liquid crystal capacitor "$C_{LC}$" in the $m^{th}$ pixel region "PXLm" during an $m^{th}$ charging time period "Ta(m)." Further, the first TFT "T1" is turned off after the gate pulse "G(N)" falls during a first off time period "Tb(1)" to have the threshold voltage "Vth" and the $m^{th}$ TFT "Tm" is turned off after the gate pulse "G(N)" falls during an $m^{th}$ off time period "Tb(m)" to have the threshold voltage "Vth."

The feed signal "Vf" is applied to the $(n)^{th}$ gate line "Gn" by turning on the $(n)^{th}$ feed TFT "Tfn" in synchrony with the feed control signal "Vf-con" corresponding to the falling timing of the gate pulse "G(N)." Since the feed signal "Vf" has the low level voltage "Vg1" of about −10V to about −5V, the $(n)^{th}$ gate line "Gn" may be rapidly charged to the low level voltage "Vg1." In the $m^{th}$ pixel region "PXLm," the $m^{th}$ off time period "Tb(m)" is shortened and the $m^{th}$ charging time period "Ta(m)" is extended compared with those of the related art. As a result, the time available for charging the liquid crystal capacitor "$C_{LC}$" with the data pulse "D(N)" is increased so that the liquid crystal molecules can be sufficiently re-aligned and the required transmittance can be obtained.

In addition, the first charging time period "Ta(1)" and the $m^{th}$ charging time period "Ta(m)" are substantially equal in duration to each other, and the first off time period "Tb(1)" and the $m^{th}$ off time period "Tb(m)" are substantially equal in duration to each other. Therefore, the first pixel region "PXL1" and the $m^{th}$ pixel region "PXLm" may have substantially the same available time period for charging the data pulse "D(N)" regardless of the RC delay, and display quality deteriorating effects such as image sticking and flicker may be reduced or eliminated.

Figure 9:
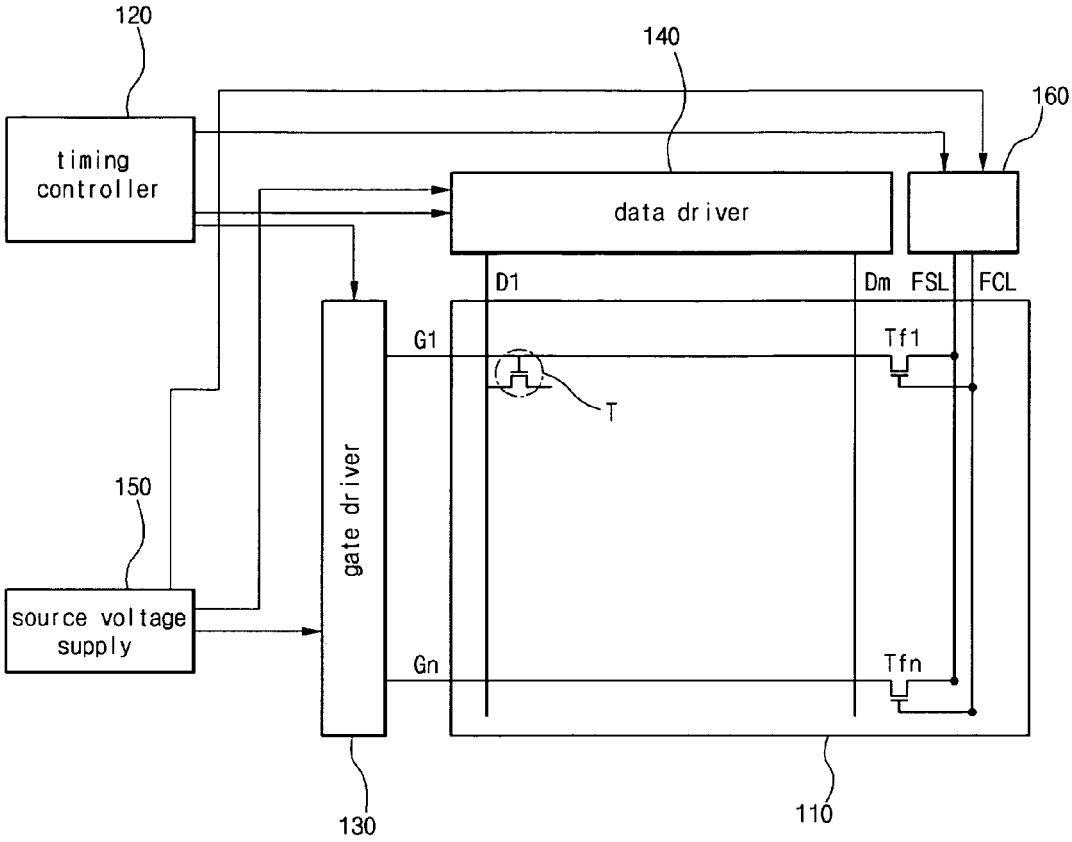
FIG. 9 is a schematic block diagram showing a liquid crystal display device according to an embodiment of the present invention.

FIG. 9 is a schematic block diagram showing a liquid crystal display device according to an embodiment of the present invention.

In FIG. 9, a liquid crystal display (LCD) device includes a liquid crystal panel 110, a timing controller 120, a gate driver 130, a data driver 140, a source voltage supply 150 and a feed control circuit 160.

A plurality of gate lines "G1" to "Gn" and a plurality of data lines "D1" to "Dm" are formed in the liquid crystal panel 110 and are driven respectively by the gate driver 130 and the data driver 140. The plurality of gate lines "G1" to "Gn" and the plurality of data lines "D1" to "Dm" cross each other to define a plurality of pixel regions. For each pixel region, a thin film transistor (TFT) "T" is connected to the corresponding gate line and the corresponding data line, and a liquid crystal capacitor (not shown) connected to the TFT "T" is formed in each pixel region. The liquid crystal capacitor is turned on/off by the TFT "T," thereby modulating the transmittance of an incident light and displaying images. A plurality of feed TFTs "Tf1" to "Tfn" are connected to ends of the plurality of gate lines "G1" to "Gn," respectively.

RGB data and timing sync signals, such as clock signals, horizontal sync signals, vertical sync signals and data enable signals, are input from an external driving system (not shown), such as a personal computer, to the timing controller 120 through an interface (not shown). The timing controller 120 generates gate control signals for the gate driver 130, including a plurality of gate integrated circuits (ICs), and data control signals for the data driver 140, including a plurality of data ICs. Moreover, the timing controller 120 outputs data signals to the data driver 140. The timing controller 120 further generates a gate output enable signal "GOE" so that the gate driver 130 can output a gate signal.

The gate driver 130 controls the ON/OFF operation of the thin film transistors (TFTs) in the liquid crystal panel 110 according to the gate control signals from the timing controller 120. The gate driver 130 sequentially enables the plurality of gate lines "G1" to "Gn." Accordingly, the data signals from the data driver 140 are supplied to pixel electrodes in the pixel regions of the liquid crystal panel 110 through the TFTs "T." The source voltage supply 150 supplies source voltages to elements of the LCD device and a common voltage to the liquid crystal panel 110. The source voltage supply 150 may generate a low level voltage "Vg1" that can be used as the feed signal "Vf" (of FIG. 7).

The data driver 140 determines reference voltages for the data signals according to the data control signals and outputs the determined reference voltages to the liquid crystal panel 110 to control a rotation angle of liquid crystal molecules.

The feed control circuit 160 may include a feed signal generator and a feed control signal generator generating a feed signal "Vf" (of FIG. 7) and a feed control signal "Vf-con" (of FIG. 7), respectively. The feed signal "Vf" (of FIG. 7) is supplied to the plurality of feed TFTs "Tf1" to "Tfn" through a feed signal line "FSL" and the feed control signal "Vf-con" (of FIG. 7) is supplied to the plurality of feed TFTs "Tf1" to "Tfn" through a feed control line "FCL." For example, the feed control circuit 160 may include a level shifter. The gate output enable (GOE) signal of the timing controller 120 may be supplied to the level shifter of the feed control circuit 160 and amplified to be used as the feed control signal "Vf-con" (of FIG. 7).

In the liquid crystal display device and the method of driving the liquid crystal display device according to the present invention, display quality deteriorating effects such as flicker, non-uniform brightness, and vertical cross-talk and image sticking resulting from distortion of the gate pulse due to the RC delay of the gate line may be reduced or eliminated, thereby providing images of high display quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driver circuit for an LCD display comprising;

a plurality of gate lines each receiving a gate pulse having one of a low level voltage to turn off a thin film transistor connected to each of the plurality of gate lines and a high level voltage to turn on the thin film transistor;

a gate driver supplying the gate pulse;

a plurality of data lines crossing the plurality of gate lines;

a plurality of feed TFTs connected to the plurality of gate lines;

a feed control line connected commonly to all of the plurality of feed TFTs to switch on the plurality of feed TFTs simultaneously; and a feed signal line connected to the plurality of feed TFTs to supply a feed signal simultaneously to the plurality of gate lines through the plurality of feed TFTs, wherein the feed signal has the low level voltage turning off the thin film transistor, wherein a feed control signal having the high level voltage is supplied to the feed control line to turn on the plurality of feed TFTs, wherein the plurality of gate lines include first and second gate lines adjacent to each other, and wherein a feed time period of the high level voltage of the feed control signal is disposed between a first time period of the high level voltage of the gate pulse received by the first gate line and a second time period of the high level voltage of the gate pulse received by the second gate line.

2. The driver circuit according to claim 1, further comprising a feed control circuit including a feed signal generator to supply the feed signal to the feed signal line and a feed control signal generator to supply the feed control signal to the feed control line to turn on the feed TFT.

3. The driver circuit according to claim 1, wherein the feed signal has a voltage within a range of about −10V to about −5V.

4. The driver circuit according to claim 1, wherein the feed control signal has a voltage within a range of about 20V to about 30V.

5. The driver circuit according to claim 1, wherein the feed control signal is a pulse synchronized with a trailing edge of the gate pulse.

6. The driver circuit according to claim 1, further comprising:

a timing controller to control the gate driver, wherein the feed control signal is a pulse synchronized with a rising edge of a GOE signal generated by the timing controller.

7. The driver circuit according to claim 1, wherein the feed thin film transistor has a gate electrode, a source electrode and a drain electrode, wherein the gate electrode is connected to the feed control line, wherein the source electrode is connected to the feed signal line, and wherein the drain electrode is connected to the gate line.

8. The device according to claim 2, further comprising:

a data driver connected to the data line to supply data pulses to the data line; and a timing controller connected to the gate driver, the data driver and the feed control circuit.

9. The device according to claim 8, wherein the feed control circuit is integrated with the timing controller.

10. The device according to claim 1, wherein the feed TFT and the gate driver are connected to opposite ends of the gate line, respectively.

11. A method of driving an LCD display, comprising:

applying a gate pulse of a gate driver to a plurality of gate lines of the LCD display, wherein the gate pulse has one of a low level voltage to turn off a thin film transistor connected to each of the plurality of gate lines and a high level voltage to turn on the thin film transistor; and supplying a feed signal pulse synchronized with the gate pulse simultaneously to the plurality of gate lines through a plurality of switching elements connected to the plurality of gate lines, wherein the feed signal pulse has the low level voltage turning off the thin film transistor, wherein the plurality of switching elements are simultaneously turned on by a feed control pulse through a feed control line connected commonly to all of the plurality of switching elements, wherein the feed control pulse having the high level voltage is supplied to the feed control line to turn on the plurality of switching elements, wherein the plurality of gate lines include first and second gate lines adjacent to each other, and wherein a feed time period of the high level voltage of the feed control pulse is disposed between a first time period of the high level voltage of the gate pulse received by the first gate line and a second time period of the high level voltage of the gate pulse received by the second gate line.

12. The method according to claim 11, wherein the feed signal pulse is synchronized with a falling edge of the gate pulse.

13. The method according to claim 11, wherein supplying a feed signal pulse to the gate line comprises:

supplying the feed control pulse synchronized with the gate pulse to a switching element connected to the gate line; and supplying a feed signal voltage to the switching element.

14. The method according to claim 13, wherein supplying a feed signal voltage to the switching element includes supplying a feed signal to control the switching element in synchronization with the feed control pulse.

15. The method according to claim 13, wherein the switching element is a thin film transistor.

16. The method according to claim 15, wherein feed signal voltage has the low level voltage and the feed control pulse has the high level voltage.

17. The method according to claim 16, wherein the feed signal voltage has a voltage within a range of about −10V to about −5V.

18. The method according to claim 16, wherein the feed control pulse has a voltage within a range of about 20V to about 30V.

19. The method according to claim 11, wherein the gate pulse and the feed signal pulse are supplied to opposite ends of the gate line, respectively.

20. The method according to claim 11, further comprising providing a timing controller to control the gate driver, wherein the feed signal pulse is synchronized with a rising edge of a GOE signal generated by the timing controller.

21. The method according to claim 11, wherein the feed signal pulse is supplied to the gate line during a time period having a range of about 1 μsec to about 3 μsec.

22. An LCD device, comprising:

a first substrate having a plurality of gate lines and a plurality of data lines crossing each other, wherein a gate pulse having one of a low level voltage to turn off a thin film transistor connected to each of the plurality of gate lines and a high level voltage to turn on the thin film transistor is supplied to the plurality of gate lines;

a second substrate separated from the first substrate by a predetermined distance;

a liquid crystal layer disposed between the first and second substrates;

a gate driver supplying the gate pulse;

a plurality of feed TFTs connected to the plurality of gate lines;

a feed control line connected commonly to all of the plurality of feed TFTs to switch on the plurality of feed TFTs simultaneously; and a feed signal line connected to the plurality of feed TFTs to supply a feed signal simultaneously to the plurality of gate lines through the plurality of feed TFTs, wherein the feed signal has the low level voltage turning off the thin film transistor, wherein a feed control signal having the high level voltage is supplied to the feed control line to turn on the plurality of feed TFTs, wherein the plurality of gate lines include first and second gate lines adjacent to each other, and wherein a feed time period of the high level voltage of the feed control signal is disposed between a first time period of the high level voltage of the gate pulse received by the first gate line and a second time period of the high level voltage of the gate pulse received by the second gate line.

23. The LCD device according to claim 22, further comprising:

a timing controller to control the gate driver; and a feed control circuit including a feed signal generator to supply the feed signal to the feed signal line and a feed control signal generator to supply the feed control signal to the feed control line to turn on the feed TFT.

24. The LCD device according to claim 23, wherein the feed control signal is a pulse synchronized with a falling edge of the gate pulse.

25. The LCD device according to claim 23, wherein the feed control signal is a pulse synchronized with a rising edge of a GOE signal generated by the timing controller.

26. The LCD device according to claim 23, wherein the feed TFT and the gate driver are connected to opposite ends of the gate line, respectively.

27. The LCD device according to claim 22, wherein the feed TFT has a gate electrode, a source electrode and a drain electrode, wherein the gate electrode is connected to the feed control line, wherein the source electrode is connected to the feed signal line, and wherein the drain electrode is connected to the gate line.

* * * * *